US010559928B2

(12) United States Patent
Muro

(10) Patent No.: US 10,559,928 B2
(45) Date of Patent: Feb. 11, 2020

(54) ELECTRIC CONNECTOR

(71) Applicant: DAI-ICHI SEIKO CO., LTD., Kyoto-shi (JP)

(72) Inventor: Masataka Muro, Fukuoka (JP)

(73) Assignee: DAI-ICHI SEIKO CO., LTD., Kyoto-shi (JP)

( * ) Notice: Subject to any disclaimer, the term of this patent is extended or adjusted under 35 U.S.C. 154(b) by 0 days.

(21) Appl. No.: 16/184,192

(22) Filed: Nov. 8, 2018

(65) Prior Publication Data

US 2019/0190208 A1 Jun. 20, 2019

(30) Foreign Application Priority Data

Dec. 20, 2017 (JP) ..... 2017-243911

(51) Int. Cl.
*H01R 12/62* (2011.01)
*H01R 13/6581* (2011.01)
(Continued)

(52) U.S. Cl.
CPC ..... *H01R 13/6581* (2013.01); *H01R 12/721* (2013.01); *H01R 13/6471* (2013.01); *H01R 13/6594* (2013.01)

(58) Field of Classification Search
CPC ..... H01R 13/6592; H01R 13/6471; H01R 12/7076; H01R 13/6461; H01R 13/6581; H01R 13/6587; H01R 13/514; H01R 13/6473; H01R 13/6474; H01R 13/6477; H01R 12/53; H01R 13/7195; H01R 12/598; H01R 12/79; H01R 13/5845; H01R 9/0515; H01R 13/6658; H01R 12/62; H01R 12/724; H01R 12/775; H01R 13/6594; H01R 13/665; H01R 24/60; H01R 12/594; H01R 12/596; H01R 13/6585; H01R 2107/00; H01R 9/035; H01R 12/00; H01R 12/57; H01R 12/778; H01R 12/88; H01R 13/6582; H01R 13/6633; H01R 43/24;
(Continued)

(56) References Cited

U.S. PATENT DOCUMENTS

2008/0064266 A1* 3/2008 Givens ..... H01R 12/57 439/676
2010/0003852 A1* 1/2010 Myer ..... H01R 13/6582 439/607.17
(Continued)

FOREIGN PATENT DOCUMENTS

JP 2005-268018 9/2005
JP 2014-225412 12/2014

*Primary Examiner* — Truc T Nguyen
(74) *Attorney, Agent, or Firm* — Oblon, McClelland, Maier & Neustadt, L.L.P.

(57) ABSTRACT

A shell member that is ground-connected to a connected object is constituted by a first shell that faces the connected object and entirely covers a contact member and a second shell that faces the first shell in a part between a connecting object and the connected object. Each of the first and second shells is provided with ground contact points with a ground conducting path of the connecting object and a ground conducting path of the connected object, with a signal transmission path sandwiched between ground paths by the first and second shells and configured to achieve satisfactory electromagnetic shielding of the signal transmission path.

8 Claims, 17 Drawing Sheets

(51) Int. Cl.
*H01R 13/6471* (2011.01)
*H01R 13/6594* (2011.01)
*H01R 12/72* (2011.01)

(58) Field of Classification Search
CPC .. H01R 9/034; H01R 12/675; H01R 12/7011; H01R 12/721; H01R 12/774; H01R 12/777; H01R 13/025; H01R 13/08; H01R 13/46; H01R 13/516; H01R 13/623; H01R 13/62994; H01R 13/631; H01R 13/648; H01R 13/652; H01R 13/658; H01R 13/65802; H01R 13/6593; H01R 13/6595; H01R 13/6596; H01R 13/6597; H01R 13/6599; H01R 13/66; H01R 13/6608; H01R 13/6616; H01R 13/6625; H01R 13/719; H01R 13/74; H01R 2103/00; H01R 24/42; H01R 24/62; H01R 4/023; H01R 4/2404; H01R 4/2433; H01R 4/28; H01R 4/646; H01R 9/032; H01R 9/2408
See application file for complete search history.

(56) References Cited

U.S. PATENT DOCUMENTS

2010/0178783 A1* 7/2010 Bright ..... H01R 12/721 439/79
2011/0136380 A1* 6/2011 Kurachi ..... H01R 13/65802 439/607.35
2012/0196466 A1* 8/2012 Igarashi ..... H01R 12/775 439/329
2013/0224998 A1* 8/2013 Feldstein ..... H01R 13/6594 439/607.01
2014/0342592 A1* 11/2014 Ashibu ..... H01R 12/79 439/267
2015/0056855 A1* 2/2015 Yu ..... H01R 13/6594 439/607.01
2015/0200473 A1* 7/2015 Chiang ..... H01R 12/775 439/67
2015/0364846 A1* 12/2015 Chen ..... H01R 13/62994 439/497
2016/0104971 A1* 4/2016 Kurachi ..... H01R 12/79 439/147
2016/0198572 A1* 7/2016 Ishida ..... H01R 12/88 439/629

* cited by examiner

ELECTRIC CONNECTOR

TECHNICAL FIELD OF THE INVENTION

The present invention relates to an electric connector.

BACKGROUND OF THE INVENTION

Conventionally, in various electrical apparatuses, there has been widespread adoption of electric connectors each of which electrically connects a connecting object constituted by a signal transmission medium or the like such as a flexible flat cable (FFC) or a flexible printed circuit board (FPC) to a connected object such as a wiring board. This type of electric connector is for example mounted on a principal surface of the wiring board (connected object) for use, and the electric connector is provided with an insertion opening through which the signal transmission medium (connecting object) is inserted inward so that the signal transmission medium has its signal conducting path electrically connected to a signal conducting path of the wiring board through a contact member.

Meanwhile, in the field of recent electronics devices, electromagnetic interference caused by radiation of electromagnetic waves has presented a problem along with higher frequencies of transmission signals and increased frequency of operation, thus posing a risk, for example, of making electronics devices malfunctioning or unstable. Therefore, conventionally, the electric connector has been fitted with a conducting shell member covering an outer surface thereof, and the connecting object (signal transmission medium) has its ground conducting path electrically connected to a ground conducting path of the connected object (wiring board) via the shell member; furthermore, as can be seen from Japanese Unexamined Patent Application Publication No. 2014-225412 and Japanese Unexamined Patent Application Publication No.

2005-268018, after the connecting object (signal transmission medium) has been inserted into the electric connector, measures to enhance an electromagnetic shielding property are taken, for example, by operating an actuator having a shield member to bring a signal transmission line into a closed state or by entirely covering the electric connector with a conductive cover.

However, these conventional electric connectors work against improvement in productivity, as they require an additional operation or installation work to be carried out after the connecting object (signal transmission medium) has been inserted. Further, as for the electromagnetic shielding property, the risk of outward leak of electromagnetic waves is yet to be overcome and there is a need to further enhance electromagnetic compatibility.

The present inventor herein discloses Japanese Unexamined Patent Application Publication No. 2014-225412 and Japanese Unexamined Patent Application Publication No. 2005-268018 as examples of art related to the present invention.

It is therefore an object of the present invention to provide an electric connector designed to achieve satisfactory electromagnetic shielding of a signal transmission path without carrying out an additional operation.

SUMMARY OF THE INVENTION

In a first aspect of the present invention, in order to attain the foregoing object, an electric connector includes a contact member that electrically connects a signal transmission line of a connecting object to a signal conducting path of a connected object and a shell member electrically connects a ground transmission line of the connecting object to a ground conducting path of the connected object. In the electric connector, the shell member includes a first shell, disposed in a state of facing the connected object, that entirely covers the contact member and a second shell disposed to face the first shell and disposed between the connecting object and the connected object, and each of the first and second shells includes a connecting object ground contact point and a connected object ground contact point that are connected to the ground transmission line of the connecting object and the ground conducting path of the connected object, respectively.

According to the first aspect of the present invention thus configured, a ground path formed by the ground transmission line of the connecting object, the ground conducting path of the connected object, and the first shell of the shell member is disposed to cover one side of the contact member, and a ground path formed by the ground transmission line of the connecting object, the ground conducting path of the connected object, and the second shell of the shell member is disposed to cover the other side of the contact member, so that a signal transmission path formed by the contact member is in a state of being sandwiched by the ground path formed by the first shell and the ground path formed by the second shells. For this reason, satisfactory electromagnetic shielding of the signal transmission path is achieved by the ground paths.

In a second aspect of the present invention, it is desirable that the signal transmission line and the ground conducting path comprise a plurality of signal transmission lines and a plurality of ground conducting paths formed on the connecting object and the connected object, respectively, that the connecting object ground contact point and the connected object ground contact point comprise a plurality of connecting object ground contact points and a plurality of connected object ground contact points, respectively, provided at predetermined intervals in a direction of arrangement of the signal transmission lines and the ground conductive paths, and that the intervals between the connecting object ground contact points and the intervals between the connected object ground contact points be determined on the basis of frequencies of electric signals that are transmitted from the signal transmission lines.

The second aspect of the present invention thus configured makes it possible to, while achieving satisfactory electromagnetic shielding of the signal transmission path, appropriately adjust a contact pressure of the connection object ground contact points on the ground transmission line of the connecting object.

In a third aspect of the present invention, it is possible that the connecting object may be constituted by a flat-plate double-faced signal transmission medium with the ground transmission line formed on each of both surfaces of the signal transmission medium, that the connecting object ground contact point of the first shell may be connected to the ground transmission line formed on one of both surfaces of the signal transmission medium, and that the connecting object ground contact point of the second shell may be configured to be connected to the ground transmission line formed on the other one of both surfaces of the signal transmission medium.

In a fourth aspect of the present invention, it is possible that the signal transmission line of the connecting object may be disposed in a state of being sandwiched by the ground transmission lines provided on both surfaces of the connecting object.

In a fifth aspect of the present invention, it is possible that the connected object may be constituted by a wiring board, that the ground conducting path may be formed on each of both surfaces of the wiring board constituting the connecting object, and that the connected object ground contact points of the first and second shells may be connected to the ground conducting path formed on one of both surfaces of the wiring board.

In a sixth aspect of the present invention, it is possible that the signal conducting path of the wiring board may be disposed in a state of being sandwiched between the ground conducting paths provided on both surfaces of the wiring board.

In a seventh aspect of the present invention, it is desirable that the first shell be provided with an opening, provided in a position facing a part where the contact member is connected to the connected object, through which a connected part of the contact member is able to be seen.

The seventh aspect of the present invention thus configured makes it possible visually confirm, through the opening of the first shell, a state of the connected part of the contact member with the connected object.

In an eighth aspect of the present invention, it is possible to further include a lock member that holds the signal transmission medium constituting the connecting object.

As mentioned above, an electric connector according to the present invention is configured such that a shell member that is ground-connected to a connected object is constituted by a first shell that entirely covers a contact member in a state of facing the connected object and a second shell that faces the first shell in a part between a connecting object and the connected object, that each of those first and second shells is provided with a connecting object ground contact point and a connected object ground contact point that are connected to a ground transmission line of the connecting object and a ground conducting path of the connected object, respectively, that a signal transmission path formed by the contact member is in a state of being sandwiched between a ground path formed by the first shell and a ground path formed by the second shell, whereby satisfactory electromagnetic shielding of the signal transmission path is achieved by the ground paths. This makes it possible to achieve satisfactory electromagnetic shielding of the signal transmission path without carrying out an additional operation.

BRIEF DESCRIPTIONS OF THE DRAWINGS

DESCRIPTIONS OF THE PREFERRED EMBODIMENTS

In the following, embodiments in which the present invention is applied to receptacle connectors that are mounted on wiring boards of various types of electronics device are described in detail with reference to the drawings.

Figure 15:
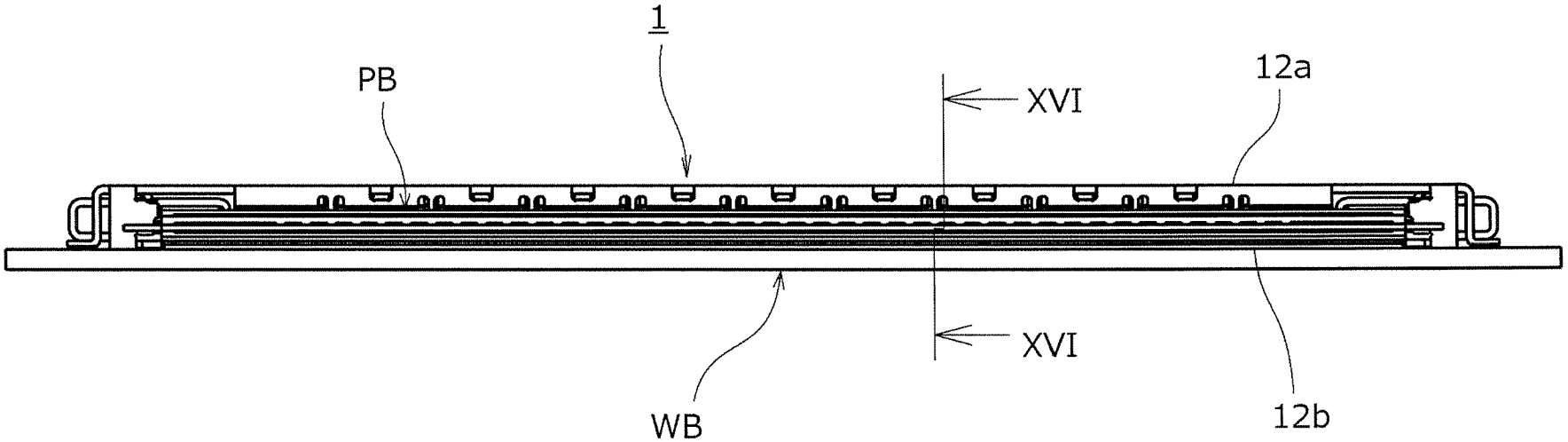
FIG. 15 is a front explanatory diagram showing a state where the receptacle connector into which the flat-plate signal transmission medium shown in FIG. 12 has been inserted has been mounted on a wiring board.

A receptacle connector 1 shown in FIGS. 1 to 9 according to an embodiment of the present invention includes a housing 11 whose outer surface is covered with a shell member 12. The housing 11 is constituted by an elongated insulating member disposed on a principal surface of a wiring board WB (see FIGS. 15 and 16) serving as a "connected object", and the shell member 12 is constituted by a conductive member.

The following assumes that the principal surface of the aforementioned wiring board WB extends horizontally, that a direction orthogonal to the principal surface of the wiring board WB is a "connector height direction", and that directions away from and toward the principal surface of the wiring board WB in the "connector height direction" are an "upward direction" and a "downward direction", respectively. Further, assuming that a direction of elongated extension of the housing 11 is a "connector longitudinal direction", a direction orthogonal to both the "connector longitudinal direction" and the "connector height direction" is called a "connector width direction".

Figure 1:
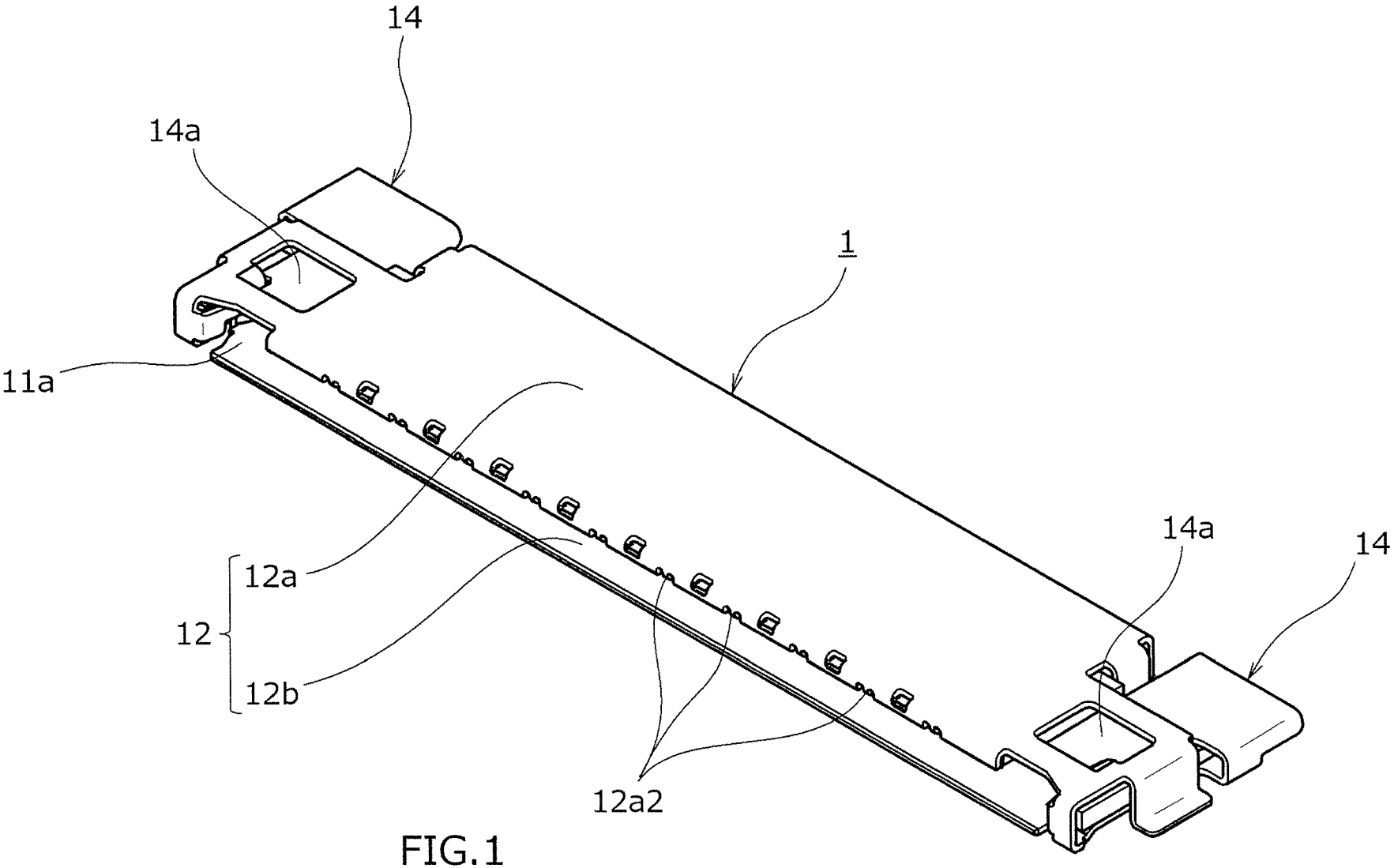
FIG. 1 is an appearance perspective explanatory diagram showing a receptacle connector according to an embodiment of the present invention from obliquely above the front.
Figure 2:
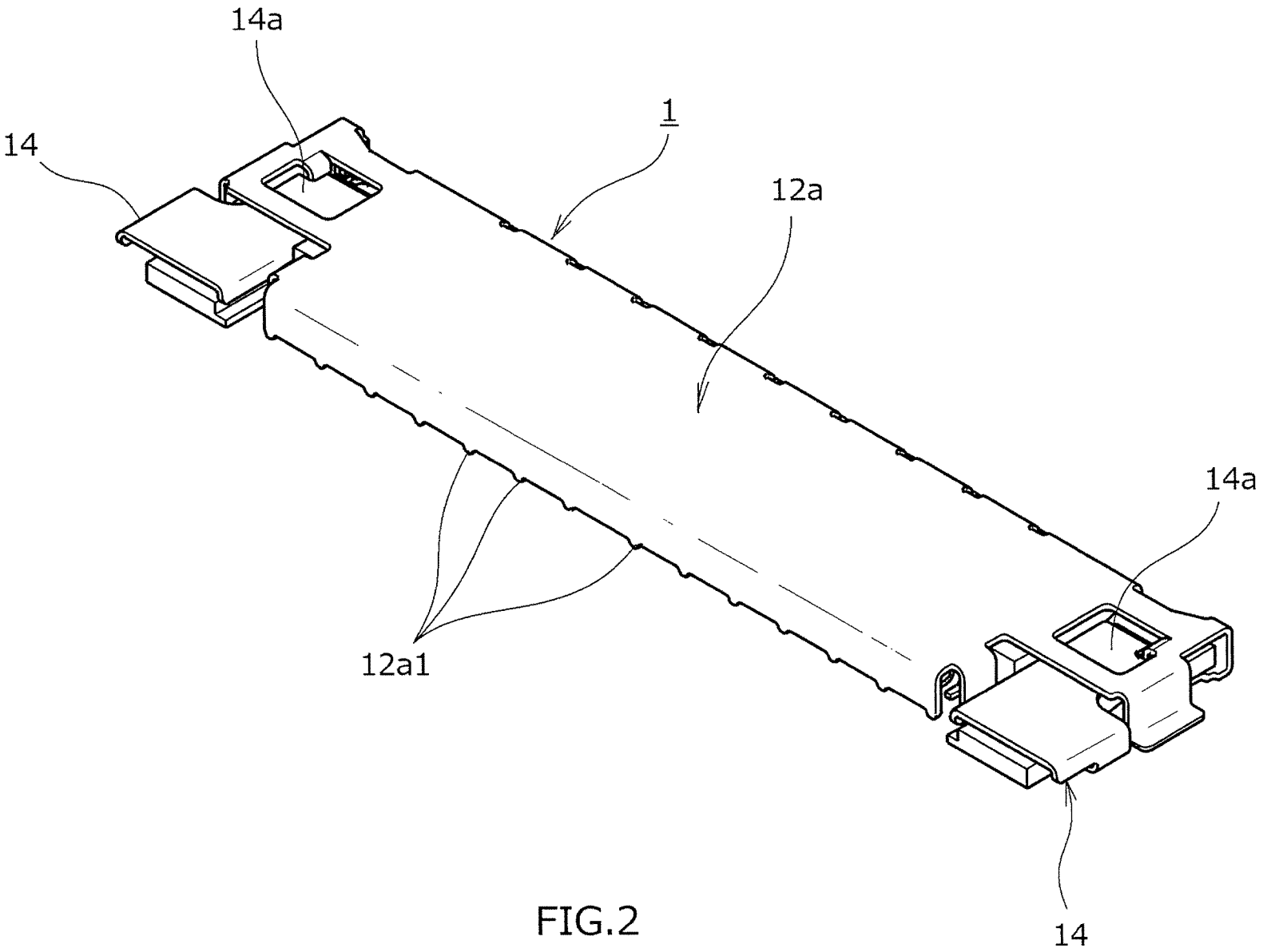
FIG. 2 is an appearance perspective explanatory diagram showing the receptacle connector shown in FIG. 1 from obliquely above the planimetric back.
Figure 3:
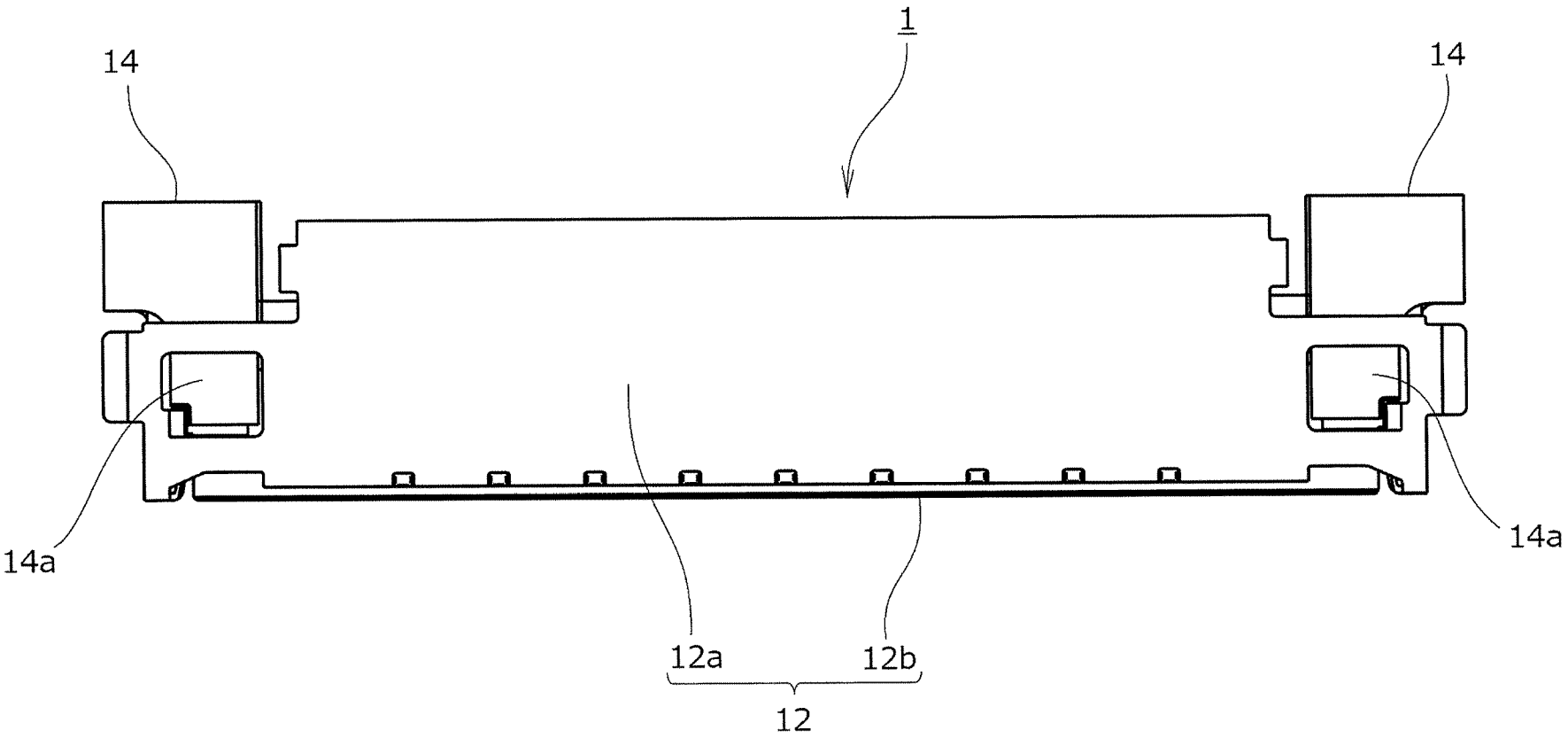
FIG. 3 is a planimetric explanatory diagram of the receptacle connector shown in FIGS. 1 and 2.
Figure 4:
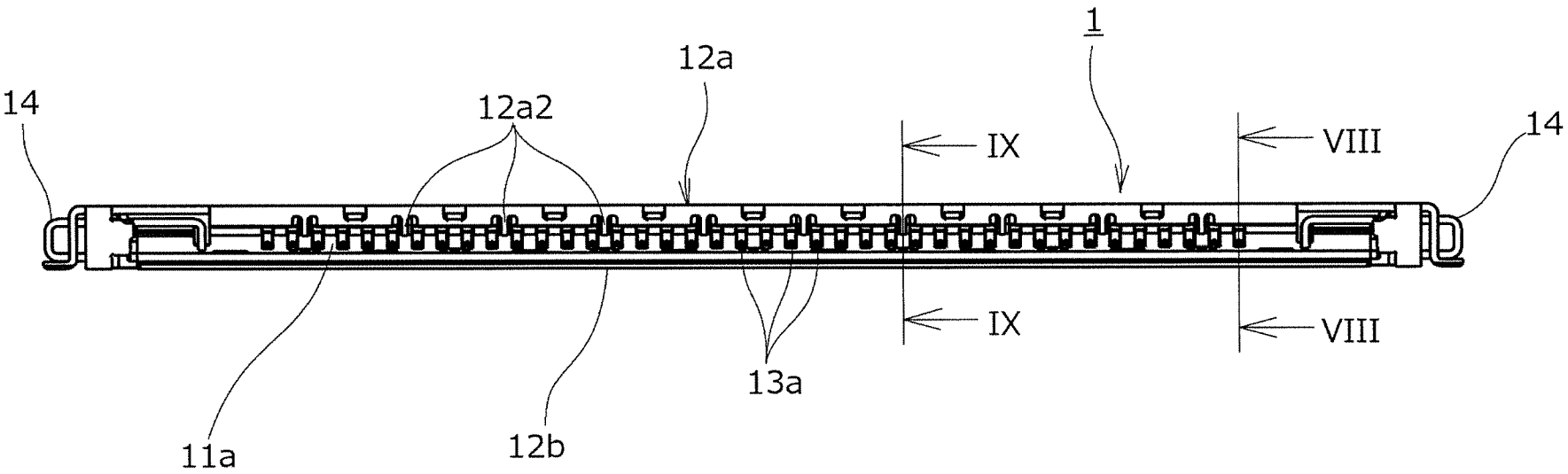
FIG. 4 is a front explanatory diagram of the receptacle connector shown in FIGS. 1 to 3.
Figure 5:
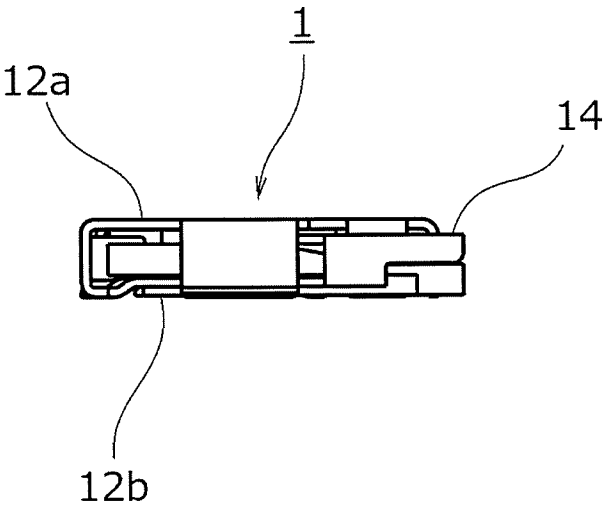
FIG. 5 is a side explanatory diagram of the receptacle connector shown in FIGS. 1 to 4.
Figure 6:
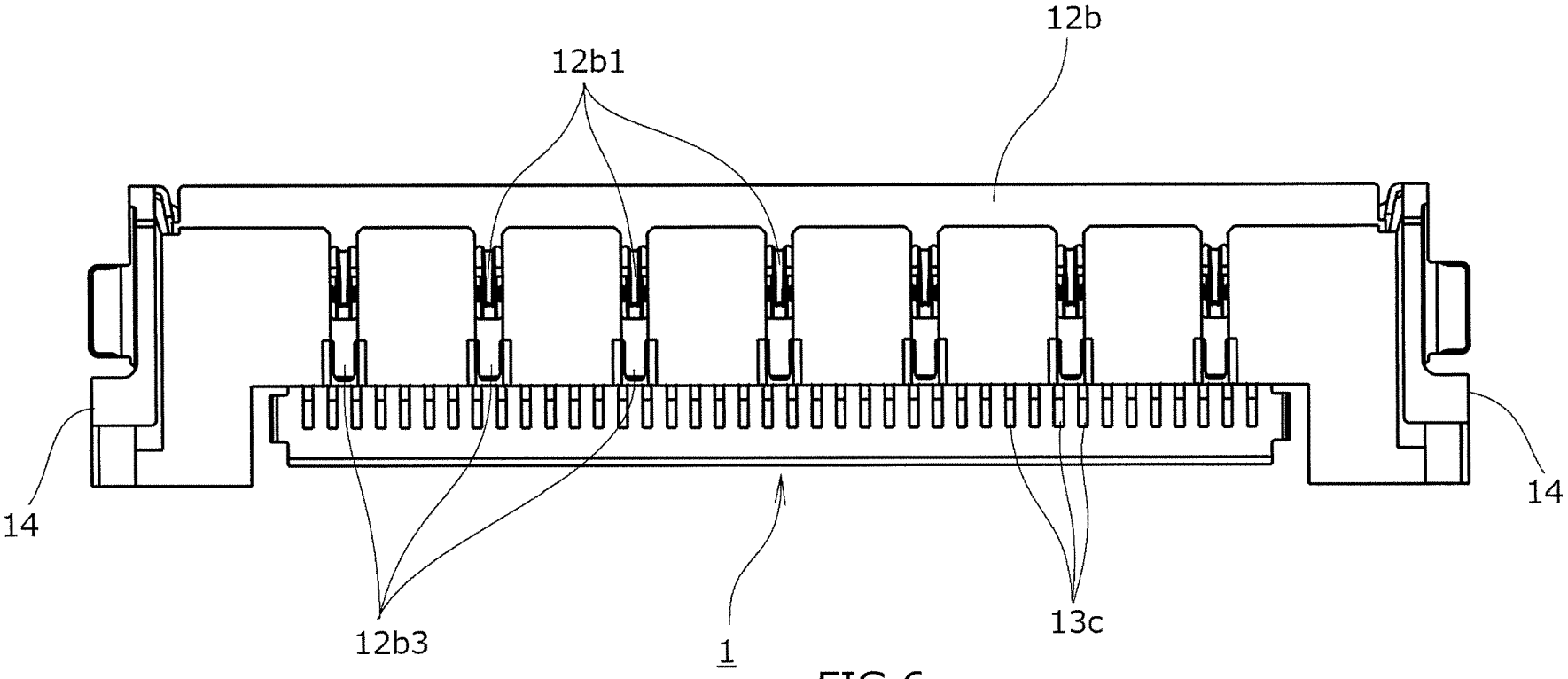
FIG. 6 is a bottom explanatory diagram of the receptacle connector shown in FIGS. 1 to 5.
Figure 7:
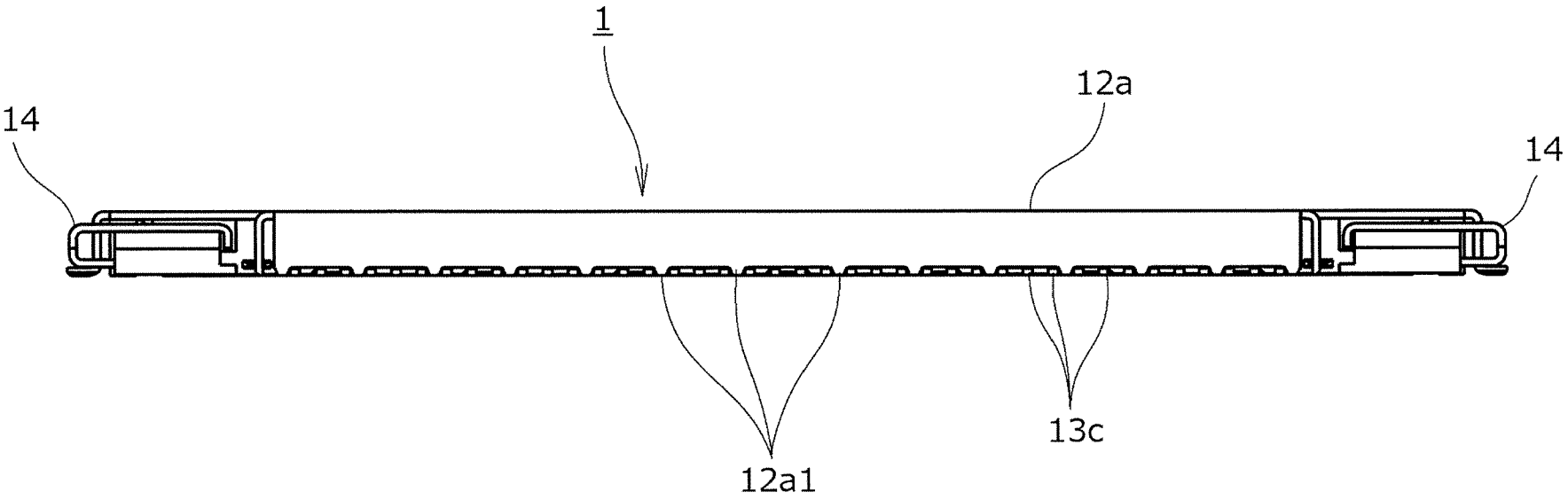
FIG. 7 is a back explanatory diagram of the receptacle connector shown in FIGS. 1 to 6.
Figure 8:
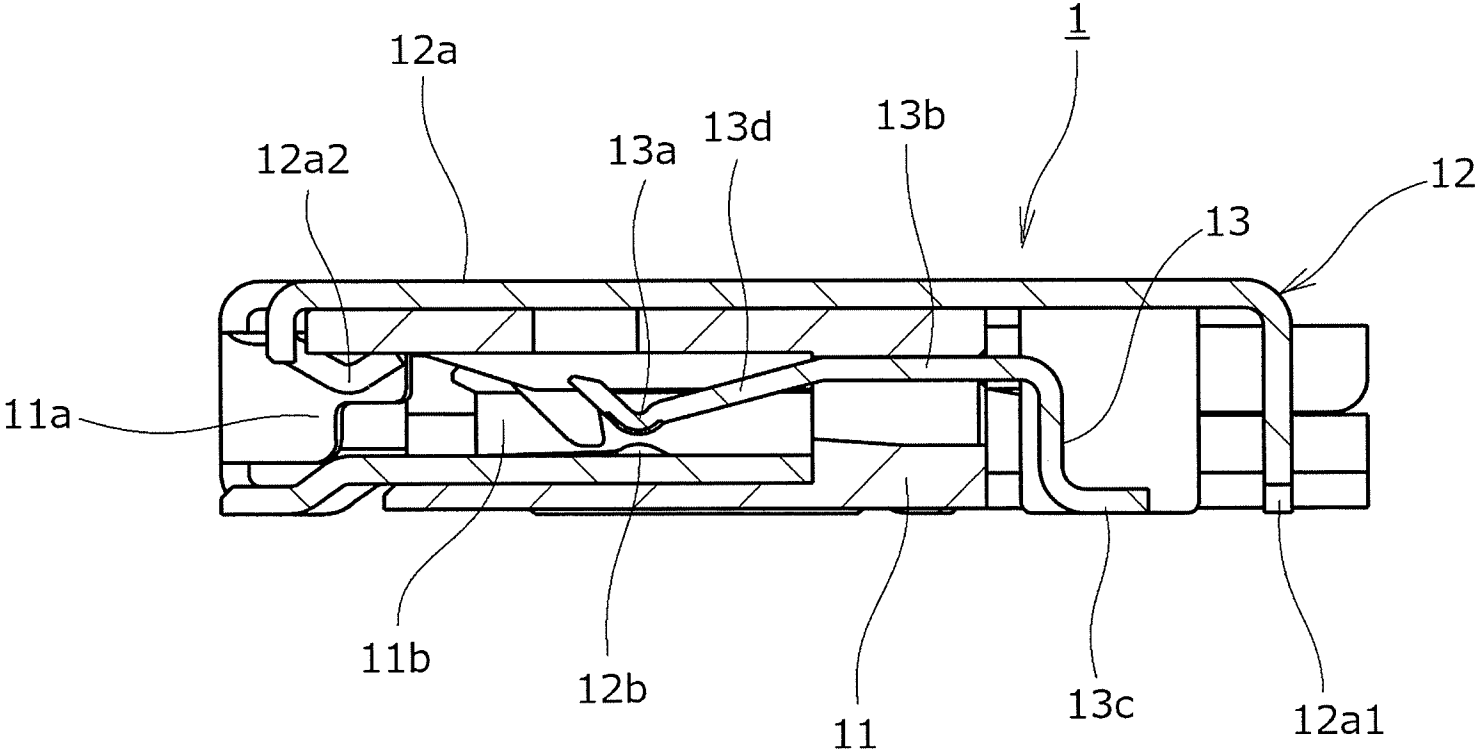
FIG. 8 is an enlarged cross-sectional explanatory diagram of a cross-section taken along line VIII-VIII in FIG. 4.
Figure 9:
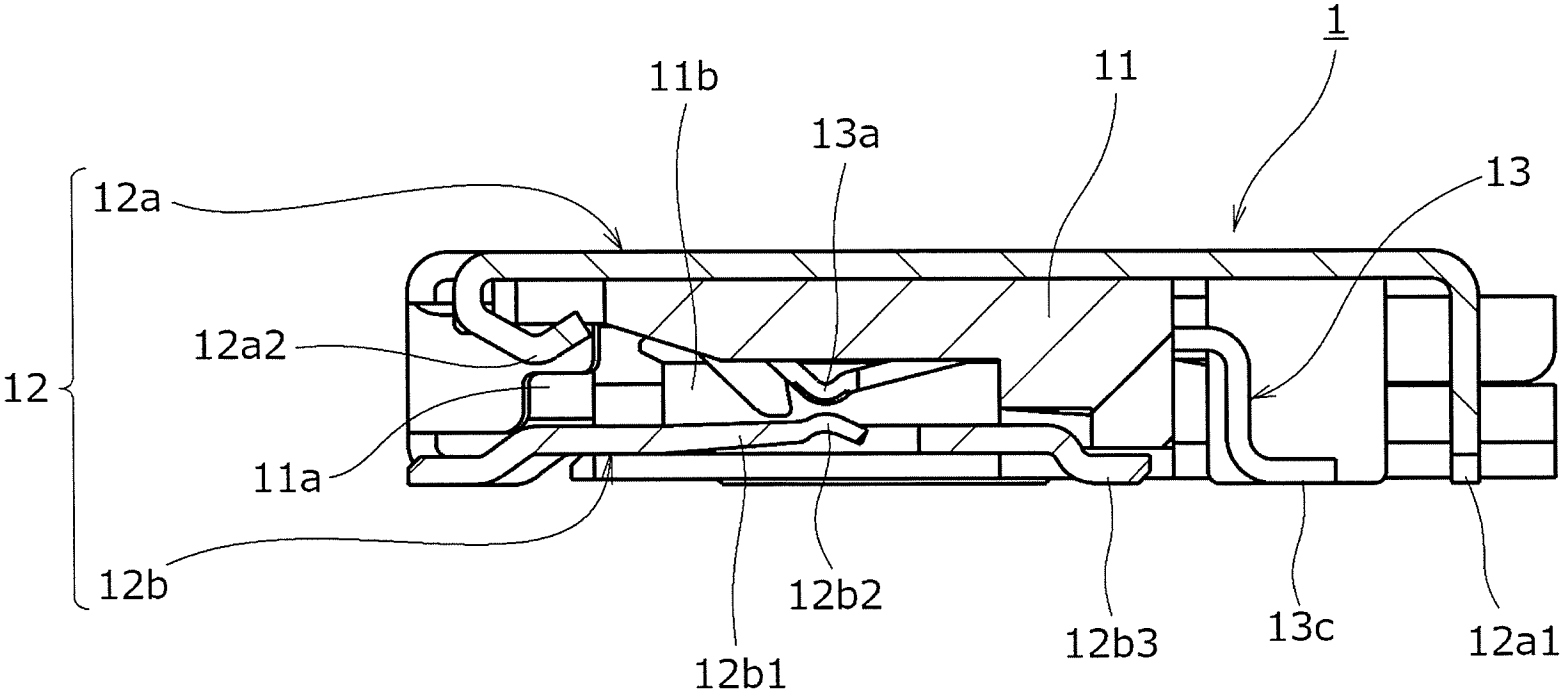
FIG. 9 is an enlarged cross-sectional explanatory diagram of a cross-section taken along line IX-IX in FIG. 4.

[Regarding Housing] (See FIGS. 8 and 9)

The aforementioned housing 11 has an insertion opening 11*a*, formed in one end face thereof in the "connector width direction" so as to form an elongated slit shape along the "connector longitudinal direction", into which a signal transmission PB serving as a flat-plate "connecting object" such as a flexible flat cable (FFC) or a flexible printed circuit board (FPC) described below is inserted. Note here that the signal transmission medium (such as an FFC or an FPC) PB and the wiring board WB are equivalent to the "connecting object" and the "connected object", respectively, in the present invention.

Further, of those end faces which form an outer circumferential surface of the housing 11, the end face provided with the aforementioned insertion opening 11*a* is hereinafter called a "front end face" and the end face opposite in the "connector width direction" to the "front end face" is hereinafter called a "back end face". Moreover, the signal transmission medium (connecting object) PB has its terminal area inserted from the "front" toward the "back" of the insertion opening 11*a*, and the terminal area of the signal transmission medium PB inserted through the insertion opening 11*a* is accommodated in the interior of a hollow medium insertion passage 11*b* provided in the housing 11 so as to extend from the insertion opening 11*a* toward the "back".

[Regarding Conductive Contacts] (See FIGS. 4 to 9)

Meanwhile, to the aforementioned housing 11, a plurality of conductive contacts (conductive terminals) 13 serving as contact members are attached in a state of being arranged at predetermined pitch distances along the "connector longitudinal direction" of the housing 11. These conductive contacts 13 are each constituted by a metal member formed by bending into the desired shape and, as will be described next, are each provided with a signal contact 13*a* disposed to stretch out into the aforementioned medium insertion passage 11*b*.

More specifically, each conductive contact (conductive terminal) 13 is disposed to extend in the "connector width direction" and has a fixing base 13*b*, fixed in the back end of the aforementioned housing 11 in a state of extending substantially horizontally, that constitutes a substantially central part of the conductive contact 13 in a direction of extension (connector width direction). A part extending from the fixing base 13*b* toward the "back" is bent at a substantially right angle toward a "lower position" immediately after projecting outward from the back end face of the housing 11. Moreover, the back end of the conductive contact 13 that extends downward reaches a principal surface of the aforementioned wiring board (connected object) WB, is again bent substantially horizontally toward the "back", and then extends horizontally substantially, and the substantially horizontally extending part forms a signal connection terminal 13*c*. The signal connection terminal 13*c* is designed to be soldered to a signal conducting path WB1 (see FIG. 16) formed on the aforementioned wiring board WB. Soldering of these signal connection terminals 13*c* at this point of time can be performed en bloc on the plurality of conductive contacts 13.

Figure 16:
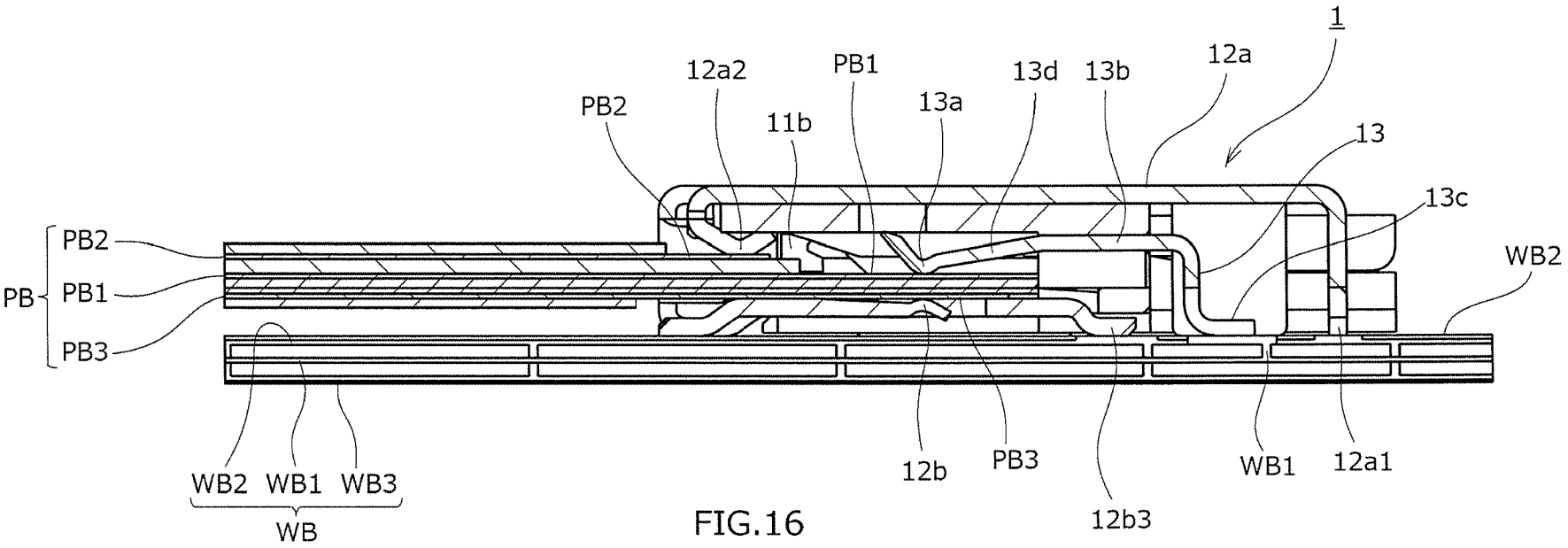
FIG. 16 is an enlarged cross-sectional explanatory diagram of a cross-section taken along line XVI-XVI in FIG. 15.

It should be noted that, as shown especially in FIG. 16, signal conducting paths WB1 provided on the aforementioned wiring board (connected object) WB are disposed in a state of being sandwiched between upper ground conducting paths WB2 and lower ground conducting paths WB3 formed on the front and back surfaces (upper and lower surfaces), respectively, of the wiring board WB, and the signal connection terminals 13*c* of the aforementioned conductive contacts 13 are formed in a state of being exposed at the principal surface (upper surface) of the wiring board WB in a place where the signal connection terminals 13*c* are soldered to the signal conducting paths WB1.

Further, a part of each of the conductive contacts (conductive terminals) 13 that extends from the fixing base 13*b* to the "front" forms a movable beam 13*d* that extends in a cantilever manner toward the inside of the aforementioned medium insertion passage 11*b*. The movable beam 13*d* is formed to be elastically displaceable up and down, centered at a junction with the fixing base 13*b* disposed in the back of the movable beam 13*d*. Moreover, at the leading end of the movable beam 13*d* in a direction of extension, the aforementioned signal contact 13*a* is provided in a state of projecting downward in a mountain shape and configured to reciprocate up and down along with the elastic displacement of the movable beam 13*d* (see FIG. 8).

Figure 13:
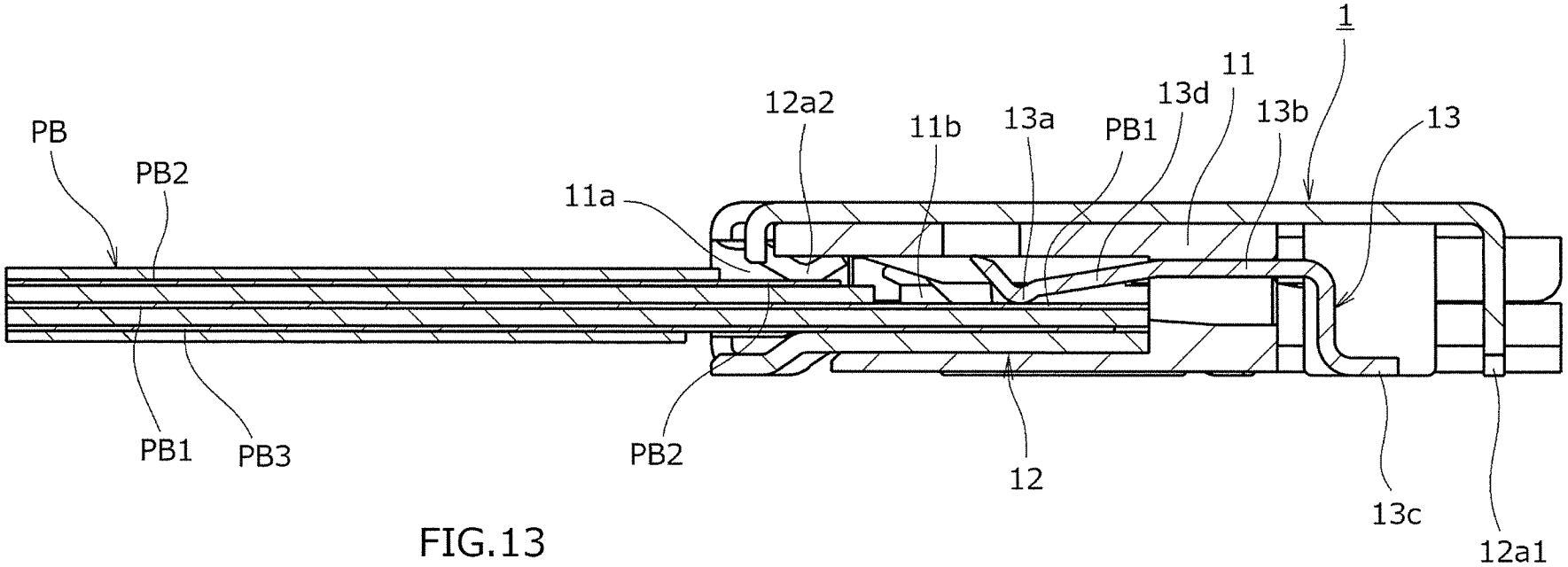
FIG. 13 is an enlarged cross-sectional explanatory diagram of a cross-section taken along line XIII-XIII in FIG. 12.
Figure 14:
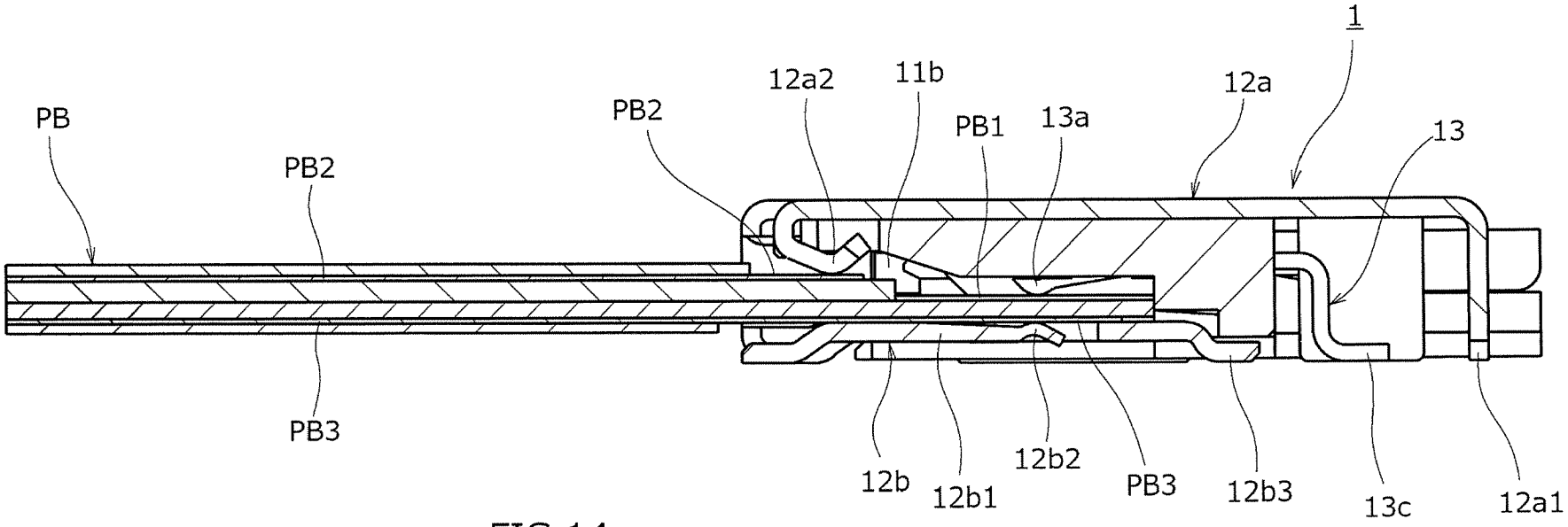
FIG. 14 is an enlarged cross-sectional explanatory diagram of a cross-section taken along line XIV-XIV in FIG. 12.

The signal contact 13*a* of this conductive contact (conductive terminal) 13 is formed in such a layout relationship as to make contact from above with the signal transmission medium (connecting object) PB inserted in the medium insertion passage 11*b* as mentioned above, and such a contact relationship allows the conductive contact 13 to be electrically connected to the signal transmission medium PB so that a signal transmission path is formed (see FIGS. 8, 13, and 14).

That is, as shown especially in FIGS. 13 and 14, the signal transmission medium (connecting object) PB has a plurality of signal transmission lines (signal lines) PB1 arranged at predetermined intervals along a plate width direction (connector width direction) of the signal transmission medium PB, and upper ground transmission lines (shield lines) PB2 and lower ground transmission lines (shield lines) PB3 are disposed via an appropriate insulating member so as to sandwich those signal transmission lines PB1 from above and below. Moreover, in the terminal area of the signal transmission medium PB, the upper ground transmission lines PB2 located thereabove are in a state of having been removed together with the insulating member, whereby the signal transmission lines PB1 are exposed upward.

Meanwhile, each of the aforementioned plurality of conductive contacts (conductive terminals) 13 is disposed in a position corresponding to the corresponding one of the plurality of signal transmission lines (signal lines) PB1 arranged in the plate width direction (connector longitudinal direction) of the signal transmission medium (connecting object) PB. Moreover, in a state of completion of insertion of the signal transmission medium PB into the medium insertion passage 11*b*, each of the signal transmission lines PB1 exposed at a surface part (i.e. an upper surface part of FIGS. 13 and 16) of the signal transmission medium PB is configured to make contact from below with the corresponding one of the signal contacts 13*a* of the conductive contacts 13 and be electrically connected by a contact pressure corresponding to an elastic force of the aforementioned movable beam 13*d*.

Moreover, an electrical connection relationship with each of the conductive contacts (conductive terminals) 13 allows the signal transmission lines (signal lines) PB1 of the signal transmission medium (connecting object) PB to be connected to the signal conducting paths WB1 of the wiring board (connected object) WB via the conductive contacts 13, whereby a "signal transmission path" leading from the signal transmission medium PB to the wiring board WB is formed.

Further, in the terminal area of such a signal transmission medium (connecting object) PB, parts of the upper ground transmission lines PB2 that are closer to the back side (i.e. the left side of FIGS. 13, 14, and 16) in a direction of extension of the signal transmission lines PB1 than exposed parts of the aforementioned signal transmission lines (signal lines) PB1 are maintained without being removed. Moreover, a part of the shell member 12 is configured to make contact from above with the ground transmission lines PB2 located thereabove. Furthermore, in a back surface part (i.e.

a lower surface part of FIGS. 13, 14, and 16) of the signal transmission medium PB, the aforementioned lower ground transmission lines (shield lines) PB3 are maintained in a state of covering the entire length of the signal transmission lines PB1, and a part of the shell member 12 is configured to make contact from below with the lower ground transmission lines PB3 located therebelow. These connection relationships are described next.

[Regarding Shell Member]

The shell member 12 fitted so as to cover the outer surface of the housing 11 as mentioned above is constituted by a body obtained by bending a thin metallic member, and is constituted by an upper shell 12*a* serving as a first shell that covers an upper part of the housing 11 and a lower shell 12*b* serving as a second shell that covers a lower part of the housing 11. The shell member 12, constituted by the upper shell (first shell) 12*a* and the lower shell (second shell) 12*b*, is configured to electrically connect the upper ground transmission lines (shield lines) PB1 and the lower ground transmission lines (shield lines) PB3 of the aforementioned signal transmission medium (connecting object) PB to the upper ground conducting paths WB2 formed on the principal surface (i.e. the upper surface of FIG. 16) of the wiring board (connected object) WB.

[Regarding Upper Shell]

That is, the upper shell (first shell) 12*a* of the shell member 12 is disposed in a state of entirely covering the conductive contacts (conductive terminals) 13 from above by covering the upper surface of the housing 11 as mentioned above. The upper shell 12*a* has its back end edge (i.e. the left end of FIGS. 13, 14, and 16) bent at a substantially right angle downward in a region located behind the aforementioned conductive contacts 13. Provided at a lower end edge of this downward bent part provided at the back end of the upper shell 12*a* are a plurality of upper shell backward ground connections 12*a*1, placed at predetermined intervals in the "connector longitudinal direction", that serve as connected object ground contact points.

Each of the plurality of these upper shell backward ground connections (connected object ground contact points) 12*a*1 is provided in correspondence with the plurality of upper ground conducting paths WB2 formed on the principal surface (i.e. the upper surface of FIG. 16) of the wiring board (connected object) WB and destined to be electrically connected by soldering. Soldering of the plurality of these upper shell backward ground connections 12*a*1 can be performed en bloc over the entire length.

Further, at the front end edge (i.e. the left end of FIGS. 9, 13, 14, and 16) of the aforementioned upper shell (first shell) 12*a*, a plurality of upper shell forward ground connections (connecting object ground contact points) 12*a*2 are provided at predetermined intervals in the "connector longitudinal direction". Each of these upper shell forward ground connections 12*a*2 is formed so that a part of the front end edge of the aforementioned upper shell 12 is bent downward. The bent part provided at the front end of the upper shell 12*a* is formed so that a shape thereof as seen from the side as shown in FIG. 9 projects downward in a substantially mountain shape, and a vertex of the bent part forming the substantially mountain shape in the side view forms an upper shell forward ground connection 12*a*2 stretching out toward the inside of the aforementioned medium insertion passage lib.

That is, each of the upper shell forward ground connections (connecting object ground contact points) 12*a*2 provide at the front end edge of the upper shell (first shell) 12*a* as mentioned above is disposed in a position corresponding to the corresponding one of the upper ground transmission lines (shield lines) PB2 disposed in the terminal area of the aforementioned signal transmission medium (connecting object) PB, and is formed in such a layout relationship as to elastically make contact from above with the upper ground transmission lines PB2 of the signal transmission medium PB inserted in the medium insertion passage lib. Moreover, such a contact relationship allows the upper shell forward ground connections 12*a*2 of the upper shell 12*a* to be electrically connected to the upper ground transmission lines PB2 of the signal transmission medium PB.

Thus, the upper shell (first shell) 12*a* has the upper shell backward ground connections (connected object ground contact points) 12*a*1, which are connected to the upper ground conducting paths WB2 provided on the principal surface (upper surface) of the wiring board (connected object) WB, and includes the upper shell forward ground connections (connecting object ground contact points) 12*a*2, which are connected to the upper ground transmission lines PB2 provided on the upper surface of the signal transmission medium (connecting object) PB. Moreover, an electrical connection relationship between these parts allows an "upper ground transmission path" to be formed to lead from the upper ground transmission lines PB2 of the signal transmission medium PB to the upper ground conducting paths WB2 of the wiring board WB via the upper shell 12*a*.

Note here that the intervals between the upper shell forward ground connections (connecting object ground contact points) 12*a*2 of the upper shell (first shell) 12*a* mentioned above are determined on the basis of the frequency of an electric signal that is transmitted from a signal conducting path including the conductive contacts (conductive terminals) 13 so that sufficient electromagnetic shielding can be achieved against the electric signal. Specifically, the intervals between the upper shell forward ground connections 12*a*2 are set so that there is no gap that is equal to or larger than 1/20 of the wavelength of the electric signal.

By thus configuring, in appropriate conditions, the intervals between which the upper shell forward ground connections 12*a*2 are placed and the number of upper shell forward ground connections 12*a*2 that are installed, it is made possible to, while achieving satisfactory electromagnetic shielding of the signal transmission path, appropriately adjust a contact pressure of the upper shell forward ground connections 12*a*2 on the upper ground transmission lines (shield lines) PB2 disposed in the terminal area of the signal transmission medium (connecting object) PB.

[Regarding Lower Shell]

Further, the lower shell (second shell) 12*b* of the aforementioned shell member 12 is attached to a bottom surface part of the housing 11, and is formed from a plate member disposed in a state of constituting a lower surface of the aforementioned medium insertion passage 11*b*. That is, this lower shell 12*b* is fitted in a state of facing the aforementioned upper shell (first shell) 12*a* from below across the conductive contacts (conductive terminals) 13, and is formed in such a layout relationship as to make contact from below with the lower ground transmission lines (shield lines) PB3 constituting the lower surface of the signal transmission medium (connecting object) PB inserted in the medium insertion passage 11*b*.

More specifically, this lower shell (second shell) 12*b* is provided with a plurality of shell springs 12*b*1 placed at predetermined intervals in the "connector longitudinal direction". Each of those shell springs 12*b*1 is formed by cutting and raising a part of the lower shell 12*b*, and extends in a cantilever manner backward from the front end of the lower shell 12*b*. Provided at the back end (i.e. the right end of FIGS. 14 and 16) of each of such shell springs 12*b*1 is a shell spring ground contact point (connecting object ground contact point) 12*b*2 stretching out upward in a substantially mountain shape.

Each of those shell spring ground contact points 12*b*2 is disposed in a position corresponding to the lower ground transmission lines (shield lines) PB3 provided on the lower surface of the signal transmission medium (connecting object) PB, and is designed to be brought into a ground connection state by making contact from below with the lower ground transmission lines PB3 of the signal transmission medium PB inserted in the medium insertion passage 11*b*.

Furthermore, the back end (i.e. the right end of FIGS. 14 and 16) of the lower shell (second shell) 12*b* having the aforementioned shell spring ground contact points (connecting object ground contact points) 12*b*2 extends substantially horizontally after being bent in a step shape toward a "lower position", and the substantially horizontally extending part forms lower shell backward ground connections (connected object ground contact points) 12*b*3. These lower shell backward ground connections 12*b*3 are soldered to the upper ground conducting paths WB2 formed on the principal surface of the aforementioned wiring board WB, thereby being brought into a ground connection state.

Further, at the back end (i.e. the left end of FIGS. 14 and 16) of such a lower shell (second shell) 12*b* opposite to the front end, a part located in the back of the aforementioned shell spring 12*b*1 is bent in a step shape toward a "lower position", and the part extending substantially horizontally backward from the lower step is mounted on the principal surface of the wiring board (connected object) WB.

Thus, the lower shell (second shell) 12*b* includes the shell spring ground contact points (connecting object ground contact points) 12*b*2, which are connected to the lower ground transmission lines (shield lines) PB3 provided on the lower surface of the signal transmission medium (connecting object) PB, and includes the lower shell backward ground connections (connected object ground contact points) 12*b*3, which are connected to the upper ground conducting paths WB2 provided on the principal surface (upper surface) of the wiring board (connected object) WB. Moreover, an electrical connection relationship between these parts allows a "lower ground transmission path" to be formed to lead from the lower ground transmission lines PB3 of the signal transmission medium PB to the upper ground conducting paths WB2 of the wiring board WB via the lower shell 12*b*.

Note here that the intervals between the shell springs 12*b*1 of the lower shell (second shell) 12*b* mentioned above and the shell spring ground contact points (connecting object ground contact points) 12*b*2 of those shell springs 12*b*1 are determined on the basis of the frequency of an electric signal that is transmitted from a signal conducting path including the conductive contacts (conductive terminals) 13 so that sufficient electromagnetic shielding can be achieved against the electric signal. Specifically, the intervals between the upper shell forward ground connections 12*a*2 are set so that there is no gap that is equal to or larger than 1/20 of the wavelength of the electric signal.

By thus configuring, in appropriate conditions, the intervals between which the shell spring ground contact points 12*b*2 are placed and the number of shell spring ground contact points 12*b*2 that are installed, it is made possible to, while achieving satisfactory electromagnetic shielding of the signal transmission path, appropriately adjust a contact pressure of the shell spring ground contact points 12*b*2 on the lower ground transmission lines (shield lines) PB3 disposed in the terminal area of the signal transmission medium (connecting object) PB.

Further, as mentioned above, the upper ground conducting paths WB2 are formed on the principal surface (upper surface) of the wiring board (connected object) WB, and as shown especially in FIG. 16, the lower ground conducting paths WB3 are formed on the back surface (lower surface) of the wiring board WB opposite to the principal surface. Moreover, the aforementioned signal conducting paths WB1 are configured to be disposed between the upper ground conducting paths WB2 and the lower ground conducting paths WB3. That is, the signal conducting paths WB1 according to the present embodiment are provided in a state of being buried in a resin base constituting the wiring board WB, and the signal conducting paths WB1 are in a state of being shielded by the upper ground conducting paths WB2 and the lower ground conducting paths WB3.

According to the present embodiment thus configured, as shown especially in FIG. 16, an "upper ground transmission path (PB2-12*a*2-12*a*-12*a*1-WB2)" formed between the signal transmission medium (connecting object) PB and the wiring board (connected object) WB via the upper shell (first shell) 12*a* is disposed to cover the upper sides of the conducting contacts (conductive terminals) 13 serving as contact members, and a "lower ground transmission path (PB3-12*b*2-12*b*-12*b*3-WB2)" formed between the signal transmission medium PB and the wiring board WB via the lower shell (second shell) 12*b* is disposed to cover the lower sides of the conductive contacts 13.

As a result, a "signal transmission path (PB1-13*a*-13-13*c*-WB1)" formed between the signal transmission medium PB and the wiring board WB via the conductive contacts 13 is in a state of being sandwiched between the aforementioned "upper ground transmission path" and "lower ground transmission path", formed between the signal transmission medium PB and the wiring board WB, via the upper shell (first shell) 12*a* and the lower shell (second shell) 12*b*, and those upper and lower ground transmission paths allow satisfactory electromagnetic shielding of the signal transmission path.

[Regarding Lock Member]

Meanwhile, a pair of lock members 14 formed integrally with the upper shell 12*a* and the lower shell 12*b* are provided at both ends of the aforementioned upper shell (first shell) 12*a* and lower shell (second shell) 12*b* in the "connector longitudinal direction". Each of those lock members 14 has a cantilever movable plate 14*a* that elastically swings up and down, and each of those movable plates 14*a* is provided with a locking nail (not illustrated) that engages with the signal transmission medium (connecting object) PB inserted in the aforementioned medium insertion passage lib (see FIGS. 2 and 3).

Figure 10:
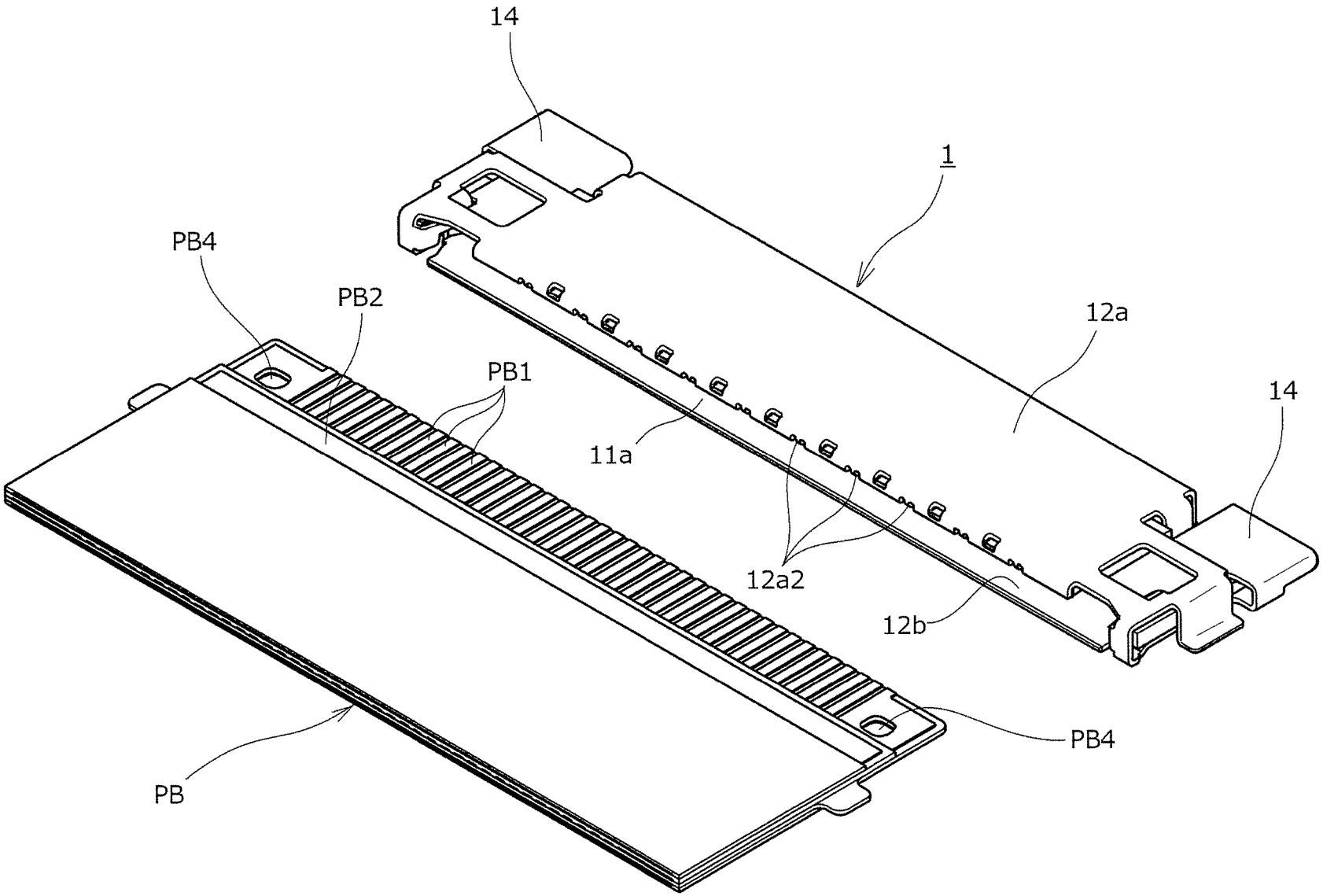
FIG. 10 is an appearance perspective explanatory diagram showing from obliquely above the front a state where a flat-plate signal transmission medium is about to be inserted into the receptacle connector shown in FIGS. 1 to 9.
Figure 11:
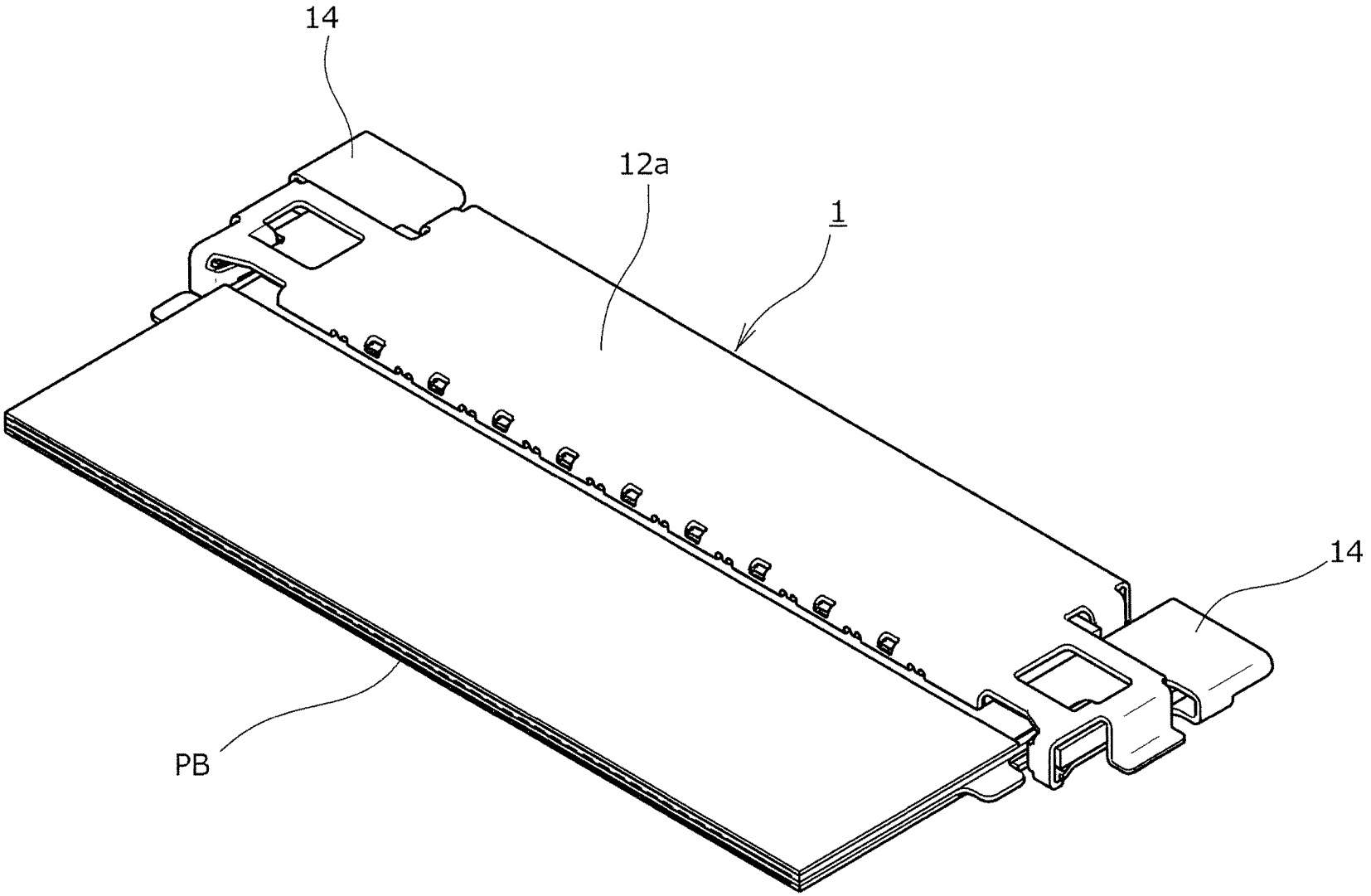
FIG. 11 is an appearance perspective explanatory diagram showing a state where the flat-plate signal transmission medium has been inserted into the electric connector out of the state shown in FIG. 10.
Figure 12:
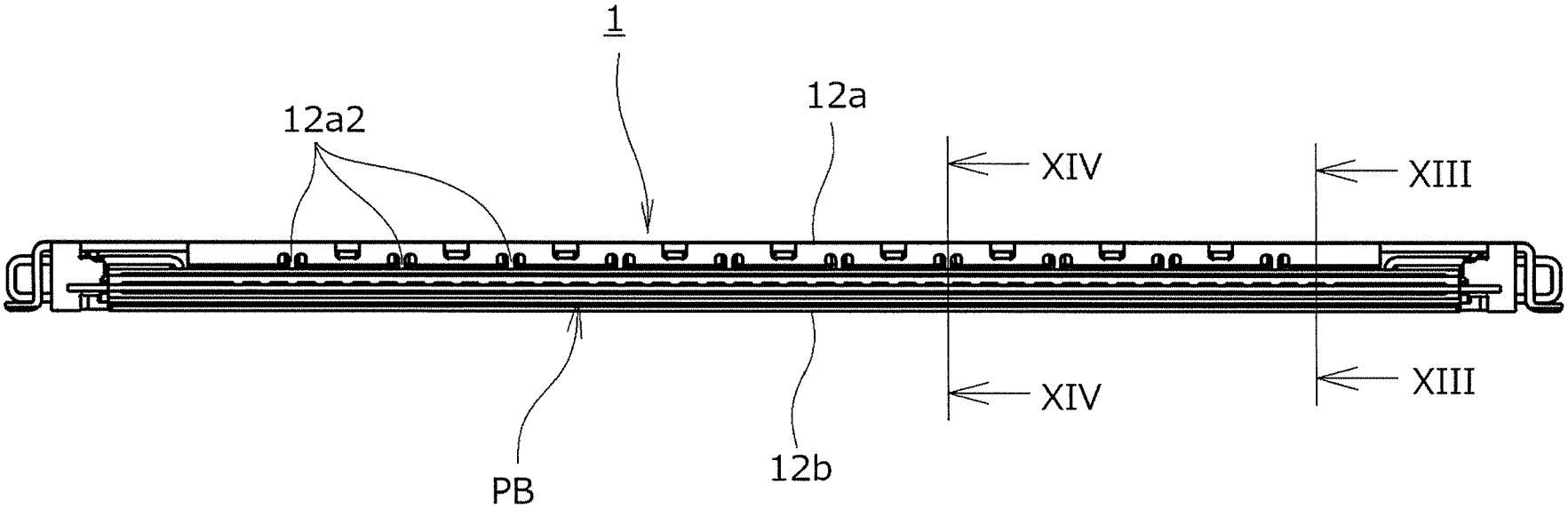
FIG. 12 is a front explanatory diagram showing a state of insertion of the flat-plate signal transmission medium shown in FIG. 11.

Meanwhile, in the terminal area of the signal transmission medium (connecting object) PB, as shown especially in FIG. 10, positioning parts PB4 constituted by depressions such as holes are formed at both end edges, respectively, of the signal transmission medium PB in the plate width direction (connector longitudinal direction). Moreover, as shown in FIG. 11, when the signal transmission medium PB has been inserted into the medium insertion passage 11*b*, the respective locking nails of the aforementioned lock members 14 engage with the positioning parts PB4 of the signal transmission medium PB, so that the state of insertion of the signal transmission medium PB is retained by the action of engagement of the locking nails with the positioning parts PB4.

The invention made by the present inventor has been described above in concrete terms on the basis of embodiments. However, the invention is not limited to the aforementioned embodiments and can of course be modified in various ways without departing from the scope of the invention.

Figure 17:
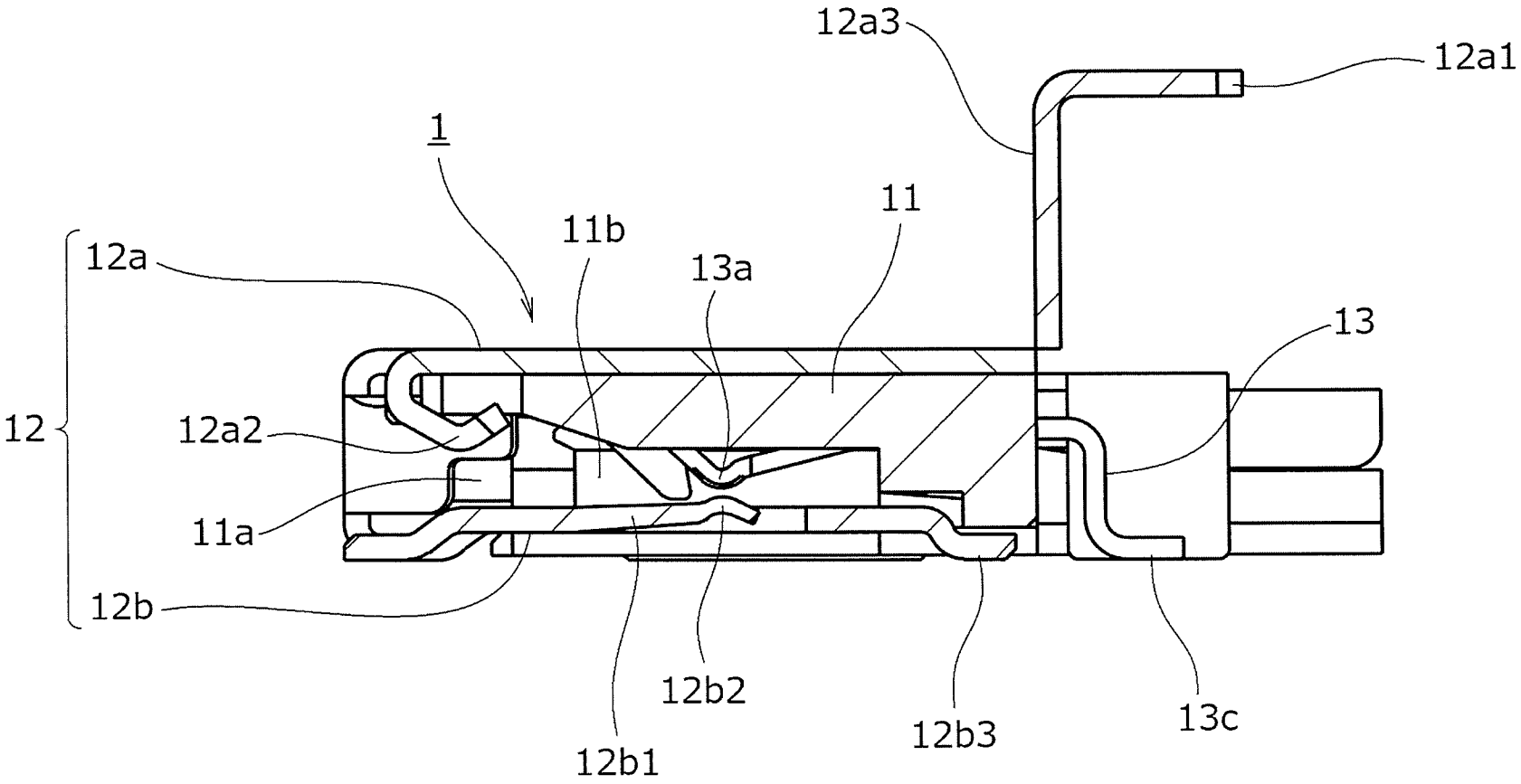
FIG. 17 is a cross-sectional explanatory diagram equivalent to FIG. 9 showing a receptacle connector according to another embodiment of the present invention.

For example, although, in each of the aforementioned embodiments, the upper shell (first shell) 12*a* is configured to form an integral cover shape that covers the entire length of the conductive contacts (contact members) 13 serving as contact members, the upper shell 12*a* can also be configured to be partially openable. As shown in FIG. 17, a more specific example is a configuration in which a backward part of the upper shell 12*a*, i.e. a part of the upper shell 12*a* that faces the signal connection terminals 13*c* of the conductive contacts 13 is configured to be an upward openable movable cover 12*a*3 and the movable cover 12*a*3 is flipped up upward into an open state, whereby the backward part of the upper shell 12*a* is provided with an opening through which the signal connection terminals 13*c* of the conductive contacts 13 can be seen.

Adopting such a configuration makes it possible to expose the signal connection terminals 13*c* of the conductive contacts (contact members) 13 outward in a step preceding soldering of the back end of the upper shell (first shell) 12*a*, and the state of connection of the conductive contacts 13 with the wiring board (connected object) WB becomes visually confirmable from above through the opening of the upper shell 12*a*, whereby manufacturing quality can be improved.

Further, although each of the aforementioned embodiments is one obtained by applying the present invention to a horizontal-insertion electric connector, the present invention is not limited to it but may also be similarly applied to a vertical-insertion electric connector.

Furthermore, an electric connector according to the present invention is not limited to one which is used to connect a flexible flat cable (FFC) or a flexible printed circuit board (FPC) as in the aforementioned embodiment, and the present invention can also be similarly applied to a wide variety of electric connectors that electrically connect a substrate to a substrate or a cable to a substrate.

As noted above, the present invention is widely applicable to a wide variety of electric connectors that are used in electrical apparatuses.

What is claimed is:

1. An electric connector comprising:

a contact member that electrically connects a signal transmission line of a connecting object to a signal conducting path of a connected object; and a shell member electrically connects a ground transmission line of the connecting object to a ground conducting path of the connected object;

wherein the shell member includes a first shell, disposed in a state of facing the connected object, that entirely covers the contact member and a second shell disposed to face the first shell and disposed between the connecting object and the connected object, wherein the first shell has a connecting object ground contact point which comes to be electrically connected to the ground transmission line provided on the connecting object, and has a connected object ground contact point which comes to be electrically connected to the ground conducting path provided on the connected object, the second shell has a connecting object ground contact point which comes to be electrically connected to the ground transmission line provided on the connecting object, and has a connected object ground contact point which comes to be electrically connected to the ground conducting path provided on the connected object, and wherein the first shell is disposed in a state of entirely covering the contact member without gaps from above, the second shell is disposed to cover the contact member from below.

2. The electric connector according to claim 1, wherein the signal transmission line and the ground conducting path comprise a plurality of signal transmission lines and a plurality of ground conducting paths formed on the connecting object and the connected object, respectively, the connecting object ground contact point and the connected object ground contact point comprise a plurality of connecting object ground contact points and a plurality of connected object ground contact points, respectively, provided at predetermined intervals in a direction of arrangement of the signal transmission lines and the ground conductive paths, and the intervals between the connecting object ground contact points and the intervals between the connected object ground contact points are determined on the basis of frequencies of electric signals that are transmitted from the signal transmission lines.

3. The electric connector according to claim 1, wherein the connecting object is constituted by a flat-plate double-faced signal transmission medium with the ground transmission line formed on each of both surfaces of the signal transmission medium, the connecting object ground contact point of the first shell is connected to the ground transmission line formed on one of both surfaces of the signal transmission medium, and the connecting object ground contact point of the second shell is configured to be connected to the ground transmission line formed on the other one of both surfaces of the signal transmission medium.

4. The electric connector according to claim 3, wherein the signal transmission line of the connecting object is disposed in a state of being sandwiched by the ground transmission lines provided on both surfaces of the connecting object.

5. The electric connector according to claim 1, wherein the connected object is constituted by a wiring board, the ground conducting path is formed on each of both surfaces of the wiring board constituting the connected object, and the connected object ground contact points of the first and second shells are connected to the ground conducting path formed on one of both surfaces of the wiring board.

6. The electric connector according to claim 5, wherein the signal conducting path of the wiring board is disposed in a state of being sandwiched between the ground conducting paths provided on both surfaces of the wiring board.

7. The electric connector according to claim 1, wherein the first shell is provided with an opening, provided in a position facing a part where the contact member is connected to the connected object, through which a connected part of the contact member is able to be seen.

8. The electric connector according to claim 3, further comprising a lock member that holds the signal transmission medium constituting the connecting object.

* * * * *